US006289858B1

(12) United States Patent
Altdorf et al.

(10) Patent No.: US 6,289,858 B1
(45) Date of Patent: Sep. 18, 2001

(54) COUPLING DEVICE FOR CONNECTING AN ELECTROMAGNETIC ACTUATOR WITH A COMPONENT DRIVEN THEREBY

(75) Inventors: Joachim Altdorf, Köln; Michael Schebitz, Eschweiler; Ernst-Siegfried Hartmann, Overath; Thomas Schwaderlapp, Dormagen; Jürgen Wahnschaffe, Bergisch Gladbach, all of (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 09/507,682

(22) Filed: Feb. 22, 2000

Related U.S. Application Data

(63) Continuation of application No. 09/428,462, filed on Oct. 28, 1999.

(30) Foreign Application Priority Data

Oct. 28, 1998 (DE) ..... 198 49 690
May 19, 1999 (DE) ..... 199 22 972

(51) Int. Cl.[7] ..... F01L 9/04

(52) U.S. Cl. ..... 123/90.11; 123/90.65; 251/129.15; 251/129.19; 335/277

(58) Field of Search ..... 123/90.11, 90.65; 251/129.01, 129.02, 129.05, 129.1, 129.15, 129.16, 129.18, 129.19; 335/277

(56) References Cited

U.S. PATENT DOCUMENTS 4,515,343 * 5/1985 Pischinger et al. ..... 251/48
5,131,624 * 7/1992 Kreuter et al. ..... 251/129.18
5,762,035 * 6/1998 Schebitz ..... 123/90.11
5,887,553 * 3/1999 Ballmann et al. ..... 123/90.11
6,047,673 * 4/2000 Lohse et al. ..... 123/90.11
6,082,315 * 7/2000 Schneider ..... 123/90.11
6,089,197 * 7/2000 Lange et al. ..... 123/90.11

* cited by examiner

*Primary Examiner*—Weilun Lo
(74) *Attorney, Agent, or Firm*—Venable; Gabor J. Kelemen

(57) ABSTRACT

An electromagnetic actuator for operating a driven component includes first and second electromagnets having respective first and second pole faces oriented toward one another and defining a space therebetween; an armature disposed in the space and movable back and forth between the first and second pole faces; a driving component attached to the armature for moving therewith as a unit; and a resetting spring assembly coupled to the armature and exerting forces opposing movements of the armature caused by electromagnetic forces generated by the electromagnets. The resetting spring assembly is in a relaxed state when the armature is in a mid position between the first and second pole faces. A coupling device connects the driving component with the driven component for effecting a transmission of pushing and pulling forces from the driving component to the driven component to cause displacements of the driven component as a function of displacements of the armature and the driving component. The coupling device includes a length-compensating arrangement between the driving and driven components.

13 Claims, 5 Drawing Sheets

COUPLING DEVICE FOR CONNECTING AN ELECTROMAGNETIC ACTUATOR WITH A COMPONENT DRIVEN THEREBY

CROSS REFERENCE TO RELATED APPLICATION

This is a continuation of pending U.S. application Ser. No. 09/428,462 filed Oct. 28, 1999.

This application claims the priority of German Application Nos. 198 49 690.7 filed Oct. 28, 1998 and 199 22 972.4 filed May 19, 1999, which are incorporated herein by reference.

BACKGROUND OF THE INVENTION

German Offenlegungsschrift (application published without examination) No. 33 07 070 discloses an electromagnetic actuator for operating a component, particularly a cylinder valve of an internal-combustion engine. The actuator has an armature which may be reciprocated back and forth between two electromagnets by magnetic forces against oppositely oriented resetting springs. The actuator system is designed in such a manner that in case the electromagnets are in a de-energized state, the armature, urged by the oppositely acting resetting springs, assumes a position between the two pole faces. In such a known system it is assumed that the two resetting springs are identical in their geometry, especially as concerns their length in a relaxed state and their spring curve. The purpose of such an identical arrangement is to ensure that essentially identical magnetic forces are needed for attracting and holding the armature at the respective pole faces and that essentially identical spring forces are present first, for accelerating the armature when its leaves the respective pole face and second, for braking the armature when it approaches the respective opposite pole face. Such springs are conventionally compression coil springs. In a mass manufacture of such coil springs, however, it is not feasible to make identical springs in sufficient quantities at an acceptable cost.

SUMMARY OF THE INVENTION

It is an object of the invention to provide an improved actuator of the above-outlined type which permits greater tolerances for the geometry and characteristics of the resetting springs.

This object and others to become apparent as the specification progresses, are accomplished by the invention, according to which, briefly stated, the electromagnetic actuator for operating a driven component includes first and second electromagnets having respective first and second pole faces oriented toward one another and defining a space therebetween; an armature disposed in the space and movable back and forth between the first and second pole faces; a driving component attached to the armature for moving therewith as a unit; and a resetting spring assembly coupled to the armature and exerting forces opposing movements of the armature caused by electromagnetic forces generated by the electromagnets. The resetting spring assembly is in a relaxed state when the armature is in a mid position between the first and second pole faces. A coupling device connects the driving component with the driven component for effecting a transmission of moving forces from the driving component to the driven component to cause displacements of the driven component as a function of displacements of the armature and the driving component. The coupling device includes a length-compensating arrangement between the driving and driven components.

An actuator according to the invention as summarized above has the advantage that the resetting spring arrangement may be composed of compression springs or tension springs or bending springs and, in particular, may be composed of a sole spring. When the armature moves out of its mid position between the two pole faces, the spring arrangement is armed to exert a resetting force on the armature against the magnetic force, and in either direction of motion the spring behavior is practically identical. The coupling device provides for the required form-fit between the driving component (such as a guide bar affixed to the armature) and the driven component (such as an engine valve of an internal combustion engine). In this manner the armature and the driven component are reciprocated as a unit in response to pushing and pulling forces. Further, by the slack adjusting means incorporated in the coupling device a reliable end position of the armature and the driven component are ensured.

Thus, if the electromagnetic actuator is used for operating an engine valve, in the de-energized state of the electromagnets the engine valve is maintained by the resetting spring arrangement in a halfway open stroke so that upon energization of one of the electromagnets, the engine valve is moved into the closed position and upon energizing the other electromagnet, the engine valve is moved into the fully open position. To counteract external interferences which disturb the operation of the engine valves, such as the fluctuating temperatures which result in alternating lengths of the driving and the driven components, and also to compensate for component wear which may likewise lead to length changes, the coupling element provides for an automatic length compensation. In particular, in case the actuator is used for driving an engine valve, it is of importance that in the closed position of the engine valve the valve head lies tightly against the valve seat and at the same time the armature engages the pole face of the closing magnet. Only these simultaneous occurrences ensure that the closed position of the valve may be maintained with a minimum holding current and thus with a small energy input. Upon an increase of the operating temperature, the driving component (that is, the guide bar affixed to the armature) as well as the driven component (that is, the valve stem of the engine valve) lengthen. Consequently, in case of a rigid coupling between the two components the valve head would no longer engage its valve seat when the armature lies against the pole face of the closing magnet. Therefore, the coupling device according to the invention is so designed that an overall length change of the two components (lengthening or contracting) is compensated for. Thus, in the cold condition when the total length of the components is reduced, the armature may arrive into contact with the pole face of the closing magnet when the valve head has reached the valve seat, and likewise, in case of a lengthening due to a heat-up of the valve seat, the valve head may be firmly seated when the armature has reached the pole face of the closing magnet. In this manner an automatic compensation is achieved so that in the closed position the valve head as well as the armature reliably assume at all times their contacting position with the valve seat and the pole face of the closing magnet, respectively.

According to the invention, the coupling device is resiliently yielding at least in the direction of motion of the driving and driven components. In an internal-combustion engine environment the structure of the coupling device is such that even in case of the maximum feasible overall length change of the driving and driven components, the coupling device is still at least slightly armed (tensioned)

when the valve body engages the valve seat and the armature engages the pole face of the closing magnet to ensure a reliable closed position of the valve.

Further according to the invention, the coupling device has a closed housing, serving as a basis for a number of various structural variants.

Thus, according to a first embodiment, the housing has elastic walls. Such a housing may be composed of a sleeve made, for example, of an elastomer having reinforcing fiber or metal inserts. The resilient sleeve is fixedly attached at its opposite ends to the driving and driven components, respectively, and its inner space is sealed outwardly. The required elasticity for bridging the clearance between the driving and driven components is ensured by the resilient housing material and possibly also by the particular shape of the housing. When the housing is exposed to pulling forces, the clearance between the two components increases, while in case of compressing forces the two components arrive in a direct, end-to-end contact with one another.

The sealed inner housing chamber is filled with a liquid for obtaining a dampening effect. If, during displacement of the system the coupling device is exposed to compression, the driving and the driven component approach one another and thus displace the liquid from the clearance between the two components. Thus, a braking effect takes place before the two components arrive into contact with one another. The extent of dampening may be affected by the viscosity of the liquid and also by the shape of the liquid-filled (for example, oil-filled) inner space of the sleeve, so that not only the liquid has to be displaced but, at the same time, the housing wall has to be expanded by the displaced liquid.

According to another embodiment of the invention, the housing has rigid walls and is affixed to one of the two components and further, a plunger is received in the housing and is affixed to the other component and is connected with the housing by a spring. Dependent upon the arrangement of the plunger with respect to the housing, the spring may be a compression spring or a tension spring. In one direction of motion which is the direction of valve closing in an engine environment, between the driving and the driven components an elastic coupling must be provided, while in the opposite direction of motion between the plunger and the housing a clearance must be present, so that after bridging the clearance, the two components contact one another and may move as unit in the opposite direction. If required, the clearance may be adjustable.

In the embodiment having a housing with rigid walls and a plunger guided therein, the inner space of the housing may be filled with a liquid to thus provide a dampening effect at least in one direction of motion. For this purpose the plunger is, at least in one direction of motion, designed as a piston and cooperates with a portion of the housing configured as a cylinder. The clearance between the cylinder wall and the piston wall functions as a throttled passage for the liquid; the passage communicates with the inner chamber of the housing. Further, a liquid-receiving (liquid storage) chamber is in communication through a check valve with the inner chamber of the housing and with the cylinder chamber.

To obtain a dampening effect in both directions of motion, according to a further embodiment of the invention, in the housing of the coupling device two cylinders are provided with which the plunger cooperates as a double-acting piston and further, the second cylinder is in communication through a check valve with the inner chamber of the housing.

In accordance with a further embodiment of the invention, the liquid storage chamber is provided with resiliently yielding walls. This provides for a resilient coupling device with hydraulic dampening in a closed system, since the volume changes occurring during dampening—because of the liquid exchange between the individual chambers—may be compensated for as concerns the liquid in the liquid-receiving chamber.

DESCRIPTION OF THE PREFERRED EMBODIMENTS

Figure 1:
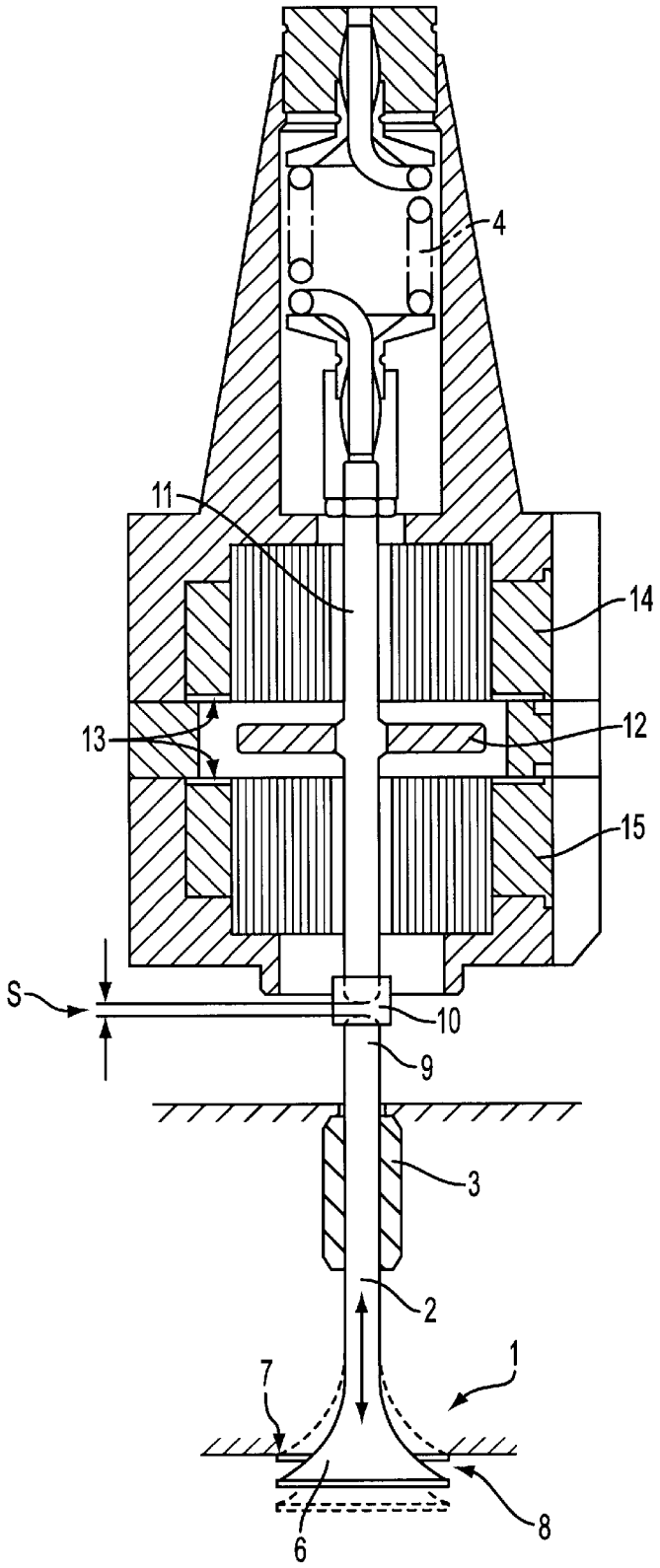
FIG. 1 is an axial sectional view of the basic arrangement of an electromagnetic actuator for operating an engine valve and incorporating the invention.

FIG. 1 is a vertical section taken through a cylinder head of a piston-type internal-combustion engine in the region of an engine valve 1 having a valve stem 2. The valve stem 2 is guided in a sealed manner in a guide 3 of the cylinder head and is coupled with a coil spring 4 which may be exposed to either pressing or pulling forces. In the illustrated position the spring 4 is in its relaxed state. The free end 9 of the valve stem 2 is connected with a guide rod 11 by a coupling device 10 structured according to the invention. The guide rod 11 is affixed to an armature 12. By means of an adjusting device located at the spring 4 the mid position of the armature 12 of the electromagnets may be set between the two spaced electromagnets 14 and 15 which the armature assumes in the de-energized state of the electromagnets.

The length of the spring 4 is so dimensioned that the valve head 6 is at rest in the half open state when the spring 4 is in a relaxed state. The gas passage opening 8 bounded by the valve seat 7 is thus half open. In case the armature 12 is moved upwardly (as viewed in FIG. 1) and thus the spring 4 is compressed, the valve head 6 engages the valve seat 7 and thus the gas passage opening 8 is closed. If the spring 4, in case of a motion in the opposite direction, is exposed to a pulling force, the gas passage opening 8 will fully open. Thus, in such an environment the engine valve composed of the valve head 6 and the valve stem 2 constitutes a driven component.

The armature 12 may be reciprocated between two pole faces 13 forming part of the respective electromagnets 14 and 15. The dimensions are such that in the relaxed state of the spring 4 the armature 12 is in its mid position between the two pole faces 13. If the electromagnet 14, serving as the closing magnet, is energized, the armature is attracted thereto and engages its pole face 13. In this state the engine valve 1 is closed.

Upon de-energizing the closing magnet 14, the armature 12, urged by the resetting spring 4, leaves the pole face 13 of the closing magnet 14. Thereafter, the electromagnet 15, serving as the opening magnet, is energized and the armature 12 is brought to the pole face 13 of the opening magnet 15 resulting in a full opening of the engine valve 1. In both directions of motion the displacement of the armature 12 first occurs under the force effect of the armed spring 4 and thereafter under the effect of the respective magnetic force acting against the resetting force of the spring 4.

The coupling device 10 is so configured that it ensures a form-fitting connection between the guide rod 11 (the driving component) and the valve stem 2 (the driven component), so that the armature 12 and the valve head 6 are reciprocated positively as a unit. The coupling device 10 bridges a predetermined valve slack S which is defined by a clearance between the driving and driven components. The coupling device 10, however, is axially slightly resilient so that length changes (either a contraction or a lengthening) of the valve stem 2 are compensated for in such a manner that every time the armature 12 engages the pole face of the closing magnet 14 the valve head 6 tightly engages the valve seat 7.

A compensation of the length changes is effected by resiliently yielding means which will be described in various embodiments as the specification progresses. They may be resilient mechanical means or hydraulic length compensating arrangements.

Figure 2:
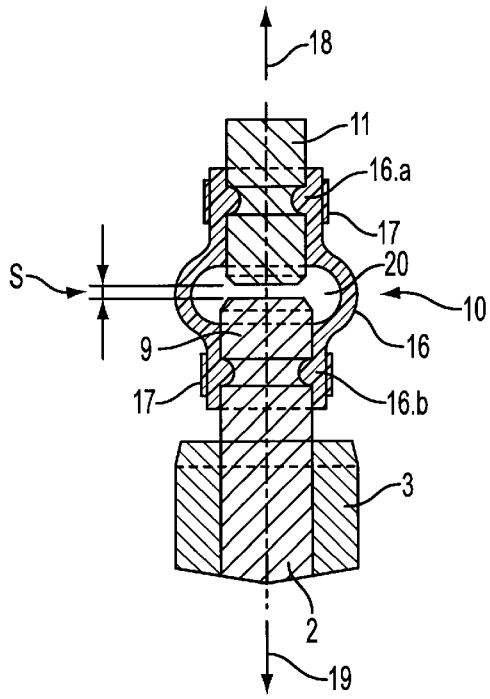
FIG. 2 is an axial sectional view of a preferred embodiment of a coupling device according to the invention.

FIG. 2 shows an embodiment of the coupling device 10 which is formed essentially of a closed housing 16 made of an elastic material such as an elastomer which may be reinforced by fiber or metal inserts. The housing 16 is provided at both ends with sleeve-like extensions 16.*a* and 16.*b* fitted onto the end of the guide bar 11 and the valve stem 2, respectively. Suitable clamping means 17 tighten the sleeve parts 16.*a* and 16.*b* to the guide bar 11 and the valve stem 2.

Upon displacement of the armature 12 in the closing direction (as indicated by the arrow 18 in FIG. 2), the guide bar 11 affixed to the armature 12 carries with it the valve stem 2 by virtue of the coupling device 10. As soon as the valve head 6 engages the valve seat 7, dependent on the length change of the entire system, the armature 12 may, while the housing 16 undergoes deformation, move further until it contacts the pole face 13 of the closing magnet 14. During this occurrence, the spring 4 is armed, that is, it exerts a force opposing the displacement of the armature.

If the valve 1 is to be moved from its closed position into its open position (as indicated by the arrow 19 in FIG. 2), the closing magnet 14 is de-energized, so that the force of the spring 4, acting in the direction of the arrow 19, moves the armature 12 in the opening direction. During this occurrence, first the armature 12 moves with the guide bar 11 (driving component), until it contacts the free end 9 of the valve stem 2 (driven component) and thus also moves the valve 1 in the opening direction. The opening magnet 15 which is energized in the meantime, captures the armature 12 until the latter contacts the pole face 13 of the opening magnet 14 and is held there for the predetermined "valve open " period. The displacements occur in a reverse direction for performing the subsequent closing step. The spring 4, armed to exert a force opposing the opening motion, will move the armature 12 after de-energization of the opening magnet 14, so that the motion process may occur in the reverse direction.

To dampen the impact of the guide bar 11 as it contacts the free end 9 of the valve stem 2, it is expedient to fill the sealed inner space 20 of the housing 16 with a dampening liquid, such as oil. The extent of the dampening effect may be controlled by a suitable selection of the viscosity of the dampening liquid and also by varying the geometry of the inner housing chamber 20. Thus, by virtue of a suitable configuration, while the clearance S is reduced by the two components 11 and 2 approaching one another, the dampening oil may be displaced only while, at the same time, an elastic deformation of the housing walls occurs.

Figure 3:
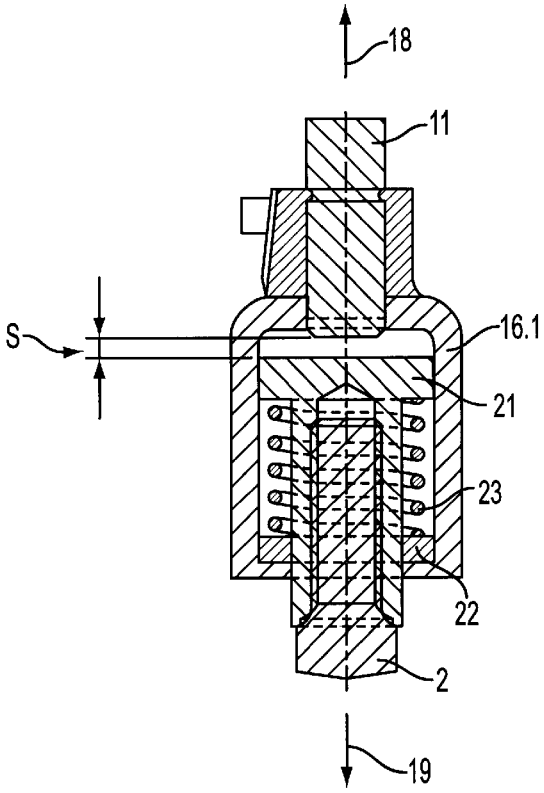
FIG. 3 is an axial sectional view of another preferred embodiment of the coupling device according to the invention.

FIG. 3 illustrates a variant of the previously described coupling device. In the embodiment according to FIG. 3 the housing 16.1 has rigid walls and is fixedly connected with the driving component (guide bar) 11. A plunger 21 axially displaceably disposed in the housing 16.1 is fixedly connected with the driven component (valve stem) 2. Between the plunger 21 and the valve-side housing wall 22 an elastic element, for example, a compression coil spring 23 is disposed. Thus, upon a closing motion as described in connection with FIG. 2, the armature 12 connected with the driving component 11 may be further moved even when the valve head 6 has already contacted the valve seat 7. During the opening motion, after bridging the valve clearance S, a part of the driving component 11 connected with the housing 16.1 first contacts the plunger 21 before the valve stem 2 is moved in the opening direction. This embodiment of the coupling device operates without dampening. Instead of the coil spring 23 a washer spring assembly may be used. With appropriate modification of the coupling of the driving and driven components the spring may be a tension spring rather than a compression spring.

Figure 4:
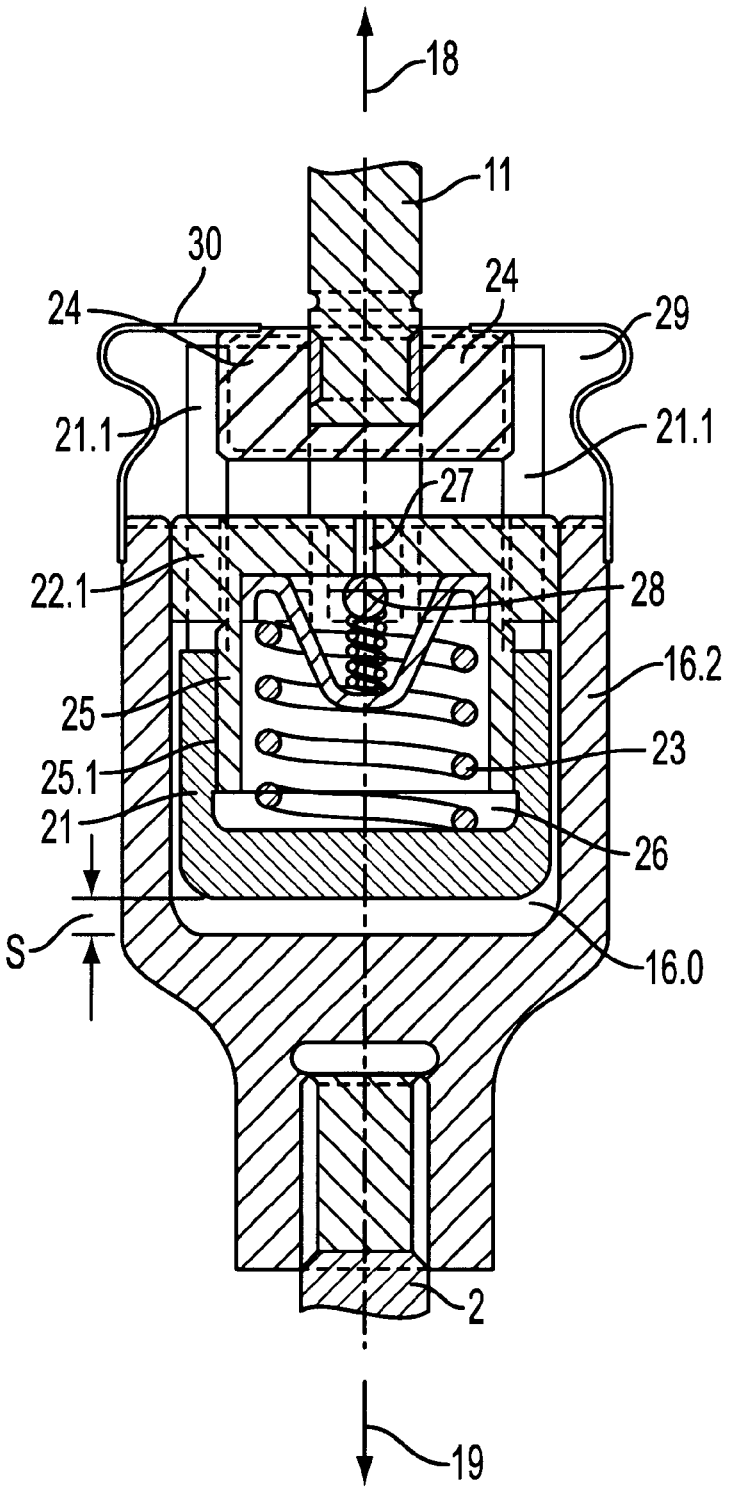
FIG. 4 is an axial sectional view of a variant of the structure illustrated in FIG. 3.

FIG. 4 is a variant of the embodiment of FIG. 3 showing a dampened system. In the embodiment according to FIG. 4, the housing 16.2 is fixedly connected with the valve stem 2. The housing 16.2 has a housing chamber 16.0 which accommodates a cup-shaped plunger 21 fixedly connected with the driving component 11 by means of connecting webs 21.1 via a coupling piece 24. The coupling webs 21.1 pass through corresponding openings provided in the housing wall 22.1.

The housing wall 22.1 is provided with an axially inwardly oriented collar 25 which, serving as a piston, extends into a chamber 26 of the plunger 21 acting as a cylinder. The clearance 25.1 between the inner wall of the plunger 21 and the outer wall of the collar 25 is so dimensioned that it throttles the liquid passing therethrough.

The plunger 21 is coupled to the housing wall 22.1 by a compression coil spring 23. The chamber 26 is in communication with a liquid storage chamber 29 by a port 27 containing a check valve 28 and by the clearance 25.1. The liquid storage chamber 29 has resiliently yielding walls 30 and is, together with the chambers 16.0 and 26, fully filled with a dampening liquid, such as oil.

If the driving component (guide bar) 11, shown in FIG. 4 in a position when the armature 12 is in its mid position, is moved in the direction of the arrow 19, the displacement is effected directly by the driving component 11 via the plunger 21.1 after bridging the valve clearance S and after a displacement of the oil from that part of the chamber 16.0. During this occurrence the check valve 28 opens and thus oil is drawn into the chamber 26 from the liquid storage chamber 29 and the motion is transmitted to the lower part of the housing 16.2 and thus the valve 1 moves in the opening direction.

Figure 5:
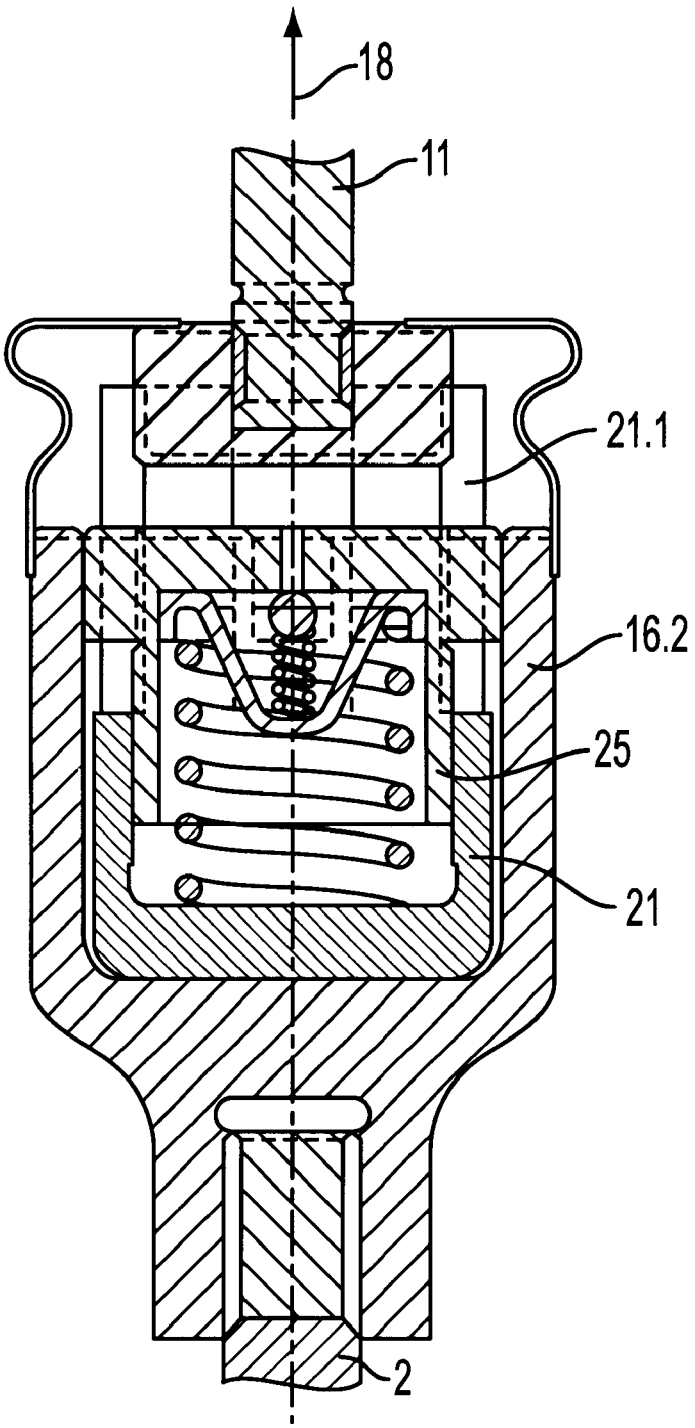
FIG. 5 is an axial sectional view of the construction shown in FIG. 4, illustrated in another operational position.

If, as shown in FIG. 5, the driving component 11 is moved in the opposite direction, that is, in the direction of the arrow 18, the plunger 21 is pulled in the direction of the housing wall 22.1. Since the check valve 28 prevents flow of oil from the chamber 26, the oil is driven through the clearance 25.1 between the plunger 21 and the collar 25; as a result the plunger 21 may move in a dampened manner in the direction of the housing wall 22.1. After the valve head 6 contacts its valve seat 7, the armature 12 arrives into contact in a dampened manner with the pole face 13 of the closing magnet 14. The oil driven through the clearance 25.1 may flow into the liquid storage chamber 29 through the chamber 16.0 and the openings provided in the housing wall 22.1 through which the webs 21.1 pass.

In the embodiments according to FIGS. 4 and 5 a motion practically only in the direction of the arrow 18 is dampened.

Figure 6:
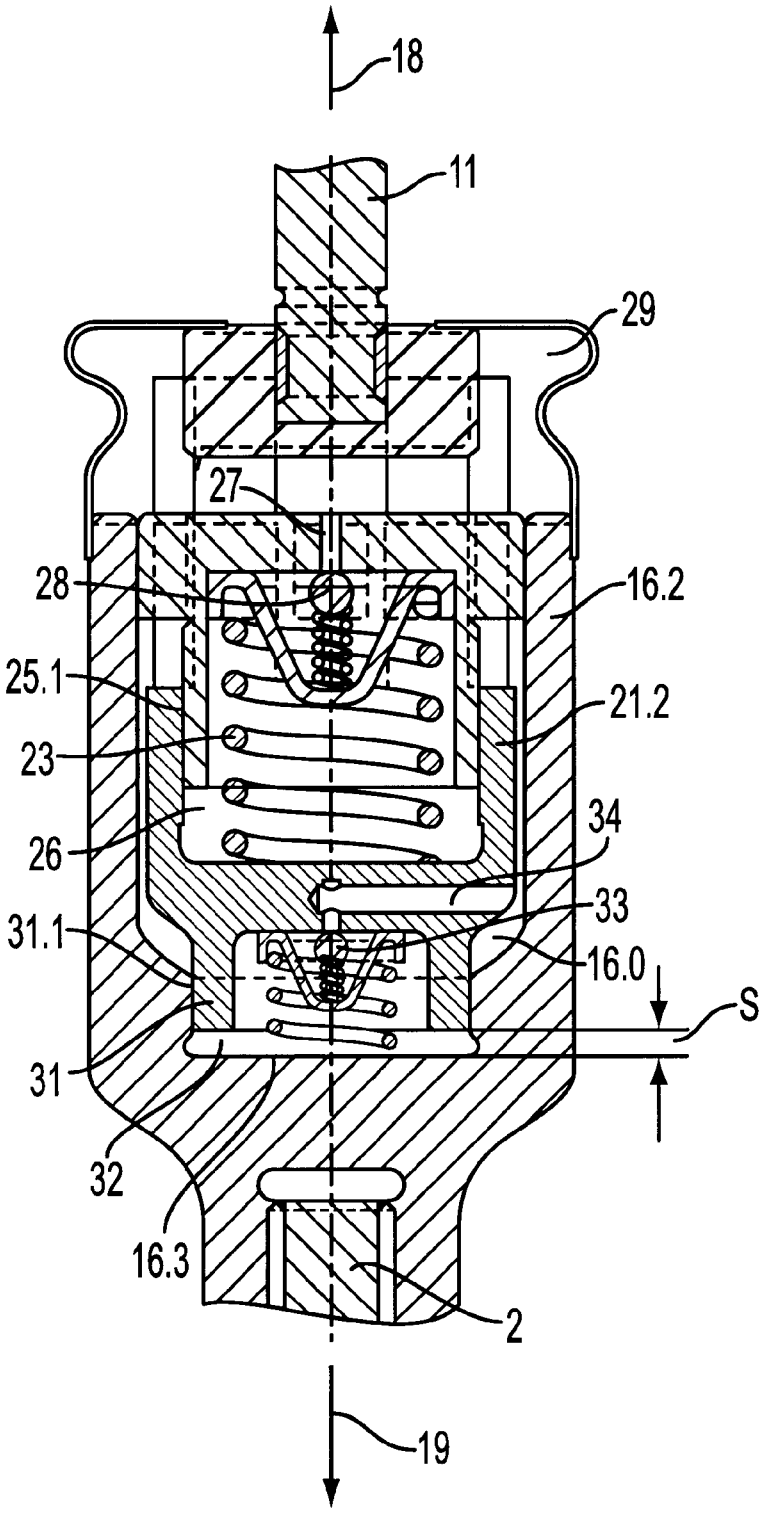
FIG. 6 is an axial sectional view of a variant of the construction shown in FIG. 4.

The embodiment according to FIG. 6 provides for a double-acting dampening operation. The basic construction corresponds to that of the embodiment of FIG. 4 and also, the operation generally is the same as described in conjunction with FIGS. 4 and 5.

In the embodiment according to FIG. 6, the plunger 21.2 is, at its face oriented towards the housing bottom 16.3, provided with a collar 31 which defines a dampening chamber 32 together with walls of the housing 16.2. The clearance 31.1 between the inner wall of the housing 16.2 and the outer wall of the collar 31 functions as a throttle. The chamber 32 is in communication with the chamber 16.0 by a port 34 containing a check valve 33. The chamber 16.0 is, in turn, in communication with the liquid storage chamber 29. During a motion in the direction of the arrow 18, similarly to the previously-described operation concerning the chamber 23, the chamber 32 is filled with oil from the chamber 16.0 through the port 34 and the open check valve 33, while oil is driven out of the chamber 26 through the throttle clearance 25.1. During a motion in the opposite direction (that is, in the direction of the arrow 19), oil is driven from the chamber 32 via the throttle clearance 31.1 into the chamber 16.0 and thus the chamber 26 is filled with oil.

As a result of the dual-working coupling device 10 of FIG. 6, during a motion in the direction of the arrow 19 the housing 16.3, shortly before completing the opening stroke, abuts, for example, the guide 3 (FIG. 1) and thus the terminal part of the armature motion towards the pole face 13 is braked by the described dampening arrangement. Consequently, the armature 12 arrives "softly" into contact with the pole face 13 of the opening magnet 14.

Expediently, a dampening liquid is provided which by external control, for example, by applying a suitable electric voltage, may change its viscosity so that an adaptation to changing operational conditions is feasible.

It will be understood that the above description of the present invention is susceptible to various modifications, changes and adaptations, and the same are intended to be comprehended within the meaning and range of equivalents of the appended claims.

What is claimed is:

1. An electromagnetic actuator in combination with a driven component, comprising (a) first and second electromagnets having respective first and second pole faces oriented toward one another and defining a space therebetween;

(b) an armature disposed in said space and movable back and forth between said first and second pole faces in opposite directions of motion;

(c) a driving component attached to said armature for moving therewith as a unit;

(d) a resetting spring assembly coupled to said armature and exerting forces opposing movements of said armature caused by electromagnetic forces generated by said electromagnets; said resetting spring assembly being in a relaxed state when said armature is in a mid position between said first and second pole faces; and (e) a coupling device connecting said driving component with said driven component; said coupling device including (1) force transmitting means for applying pushing and pulling forces from said driving component to said driven component to cause displacements of said driven component as a function of displacements of said armature and said driving component in said opposite directions of motion; and (2) a length-compensating arrangement interposed between said driving and driven components.

2. The combination as defined in claim 1, wherein said coupling device comprises means for resiliently yielding at least in a direction parallel to said direction of motion.

3. The combination as defined in claim 1, wherein said coupling device comprises a closed housing affixed to at least one of said driving and driven components.

4. The combination as defined in claim 3, wherein said housing has resilient walls.

5. The combination as defined in claim 4, wherein said housing is formed of a resilient sleeve having opposite ends attached to said driving and driven components, respectively, for allowing displacements of said driving and driven components relative to one another in said direction of motion.

6. The combination as defined in claim 3, wherein said housing has a chamber filled with a liquid.

7. The combination as defined in claim 3, wherein said housing has rigid walls; and further wherein one of said driving and driven components is attached to said housing; said coupling device further comprising (a) a housing chamber defined in said housing;

(b) a plunger received in said housing chamber for displacement therein in said direction of motion; the other of said driving and driven components being attached to said plunger; and (c) a spring disposed in said housing and arranged for exerting a force on said plunger.

8. The combination as defined in claim 7, said coupling device further comprising (d) a cylinder formed in said plunger; said cylinder having a cylinder wall and a cylinder chamber bounded by said cylinder wall;

(e) a piston forming part of said housing and received in said cylinder for sliding displacement therein in said direction of motion; said piston having an outer piston wall facing said cylinder wall;

(f) a throttle gap defined between said cylinder wall and said piston wall and maintaining a throttling communication between said housing chamber and said cylinder chamber;

(g) a liquid storage member coupled to said housing and defining a liquid storage chamber;

(h) a port provided in said piston; said port establishing communication between said cylinder chamber and said liquid storage chamber;

(i) a check valve disposed in said port and openable solely by forces directed from said liquid storage chamber toward said cylinder chamber; and (j) a dampening liquid contained in said liquid storage chamber, said cylinder chamber, said housing chamber and said throttle gap for braking a motion of said plunger relative to said housing.

9. The combination as defined in claim 8, said coupling device further comprising (k) an additional piston formed externally on said plunger; said second piston being slidable in a wall portion of said housing;

(l) an additional cylinder chamber bounded by said additional piston and parts of said housing;

(m) an additional throttle gap defined between said additional piston and said wall portion of said housing and maintaining a throttling communication between said housing chamber and said additional cylinder chamber;

(n) an additional port provided in said plunger; said additional port establishing communication between said additional cylinder chamber and said housing chamber; said liquid being contained in said additional cylinder chamber, said additional throttle gap and said additional port;

(o) an additional check valve disposed in said additional port and openable solely by forces directed from said housing chamber toward said second cylinder chamber.

10. The combination as defined in claim 9, wherein said liquid storage member has resiliently yielding walls.

11. The combination as defined in claim 1, wherein said resetting spring assembly is disposed in its entirety on one side of said armature.

12. The combination as defined in claim 11, wherein said armature is situated between said driven component and said resetting spring assembly.

13. The combination as defined in claim 11, wherein said resetting spring assembly is situated externally of said first and second electromagnets.

* * * * *